US010448478B2

(12) United States Patent
Hagelaar et al.

(10) Patent No.: US 10,448,478 B2
(45) Date of Patent: Oct. 15, 2019

(54) LED STRIP, LED LUMINAIRE, AND A METHOD OF MANUFACTURING THEREOF

(71) Applicant: SIGNIFY LIGHTING HOLDING B.V., Eindhoven (NL)

(72) Inventors: Joris Hubertus Antonius Hagelaar, Nuenen (NL); Abraham Vamattathil Scaria, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 107 days.

(21) Appl. No.: 15/510,887

(22) PCT Filed: Sep. 8, 2015

(86) PCT No.: PCT/EP2015/070418
§ 371 (c)(1),
(2) Date: Mar. 13, 2017

(87) PCT Pub. No.: WO2016/037994
PCT Pub. Date: Mar. 17, 2016

(65) Prior Publication Data

US 2018/0302961 A1 Oct. 18, 2018

(30) Foreign Application Priority Data

Sep. 12, 2014 (EP) ..... 14184517

(51) Int. Cl.
*H05B 33/08* (2006.01)
*F21S 4/24* (2016.01)
(Continued)

(52) U.S. Cl.
CPC ..... *H05B 33/086* (2013.01); *F21S 4/24* (2016.01); *H05B 33/0857* (2013.01);
(Continued)

(58) Field of Classification Search
CPC ..... F21Y 2113/10; F21Y 2115/10; F21Y 2115/20
(Continued)

(56) References Cited

U.S. PATENT DOCUMENTS

2006/0049782 A1 3/2006 Vornsand et al.
2006/0255712 A1 11/2006 Masuda et al.
(Continued)

FOREIGN PATENT DOCUMENTS

DE 202011002411 U1 8/2011
JP 2008-283155 A 11/2008
(Continued)

OTHER PUBLICATIONS

Wright, Maury, "Philips LumiLEDs Launches New Lime LED and Multi-Emitter Package, Demos at Sil," LEDs Magazine, Published on Feb. 27, 2014, (4 Pages).

*Primary Examiner* — Thuy V Tran
(74) *Attorney, Agent, or Firm* — Akarsh P. Belagodu

(57) ABSTRACT

A lighting assembly (100), an LED strip, a luminaire and a method of manufacturing a lighting assembly are provided. The lighting assembly (100) is for emitting substantially white light of a controllable correlated color temperature and comprises groups of a first light source (110), a second light source (120), a third light source (130) and a controller (140). The first light source is for emitting substantially white light having a color temperature larger than 5000 Kelvin. The second light source is for emitting substantially white light having a color temperature smaller than 2250 Kelvin. The third light source is for emitting greenish light. The greenish light has a third color point in the CIE 1931 XYZ color space within an intersection of half spaces y>=1.04 x and y>=−0.0694x+0.4525. The controller is for controlling the light emission of said light sources.

13 Claims, 3 Drawing Sheets

(51) Int. Cl.

| | |
|---|---|
| *F21Y 113/10* | (2016.01) |
| *F21Y 115/20* | (2016.01) |
| *F21Y 103/10* | (2016.01) |
| *F21Y 115/10* | (2016.01) |

(52) U.S. Cl.
CPC ..... *F21Y 2103/10* (2016.08); *F21Y 2113/10* (2016.08); *F21Y 2115/10* (2016.08); *F21Y 2115/20* (2016.08)

(58) Field of Classification Search
USPC ..... 362/227
See application file for complete search history.

(56) References Cited

U.S. PATENT DOCUMENTS

| | | | | |
|---|---|---|---|---|
| 2007/0223219 | A1* | 9/2007 | Medendorp, Jr. .... | C09K 11/586 362/231 |
| 2008/0238335 | A1 | 10/2008 | Lee et al. | |
| 2011/0279015 | A1 | 11/2011 | Negley et al. | |
| 2012/0001555 | A1* | 1/2012 | Tu ..... | F21V 7/0008 315/161 |
| 2012/0081010 | A1 | 4/2012 | Hatley et al. | |
| 2012/0201025 | A1* | 8/2012 | Cash ..... | F21K 9/232 362/231 |
| 2012/0223657 | A1 | 9/2012 | Van De Ven | |
| 2012/0326627 | A1* | 12/2012 | McDaniel, Jr. ..... | H05B 33/086 315/294 |
| 2014/0111985 | A1* | 4/2014 | Harbers ..... | H05B 33/0857 362/231 |
| 2015/0327343 | A1* | 11/2015 | Dai ..... | H05B 33/086 315/294 |
| 2016/0212804 | A1* | 7/2016 | Peeters ..... | C09K 11/0883 |

FOREIGN PATENT DOCUMENTS

| | | | |
|---|---|---|---|
| JP | 2010182724 | A | 8/2010 |
| JP | 2012-054422 | A | 3/2012 |
| JP | 2014-086271 | A | 5/2014 |
| WO | 2007123940 | A2 | 11/2007 |
| WO | 2010122312 | A1 | 11/2010 |
| WO | 2012/090356 | A1 | 7/2012 |
| WO | 2013140296 | A1 | 9/2013 |
| WO | 2013166524 | A1 | 11/2013 |

* cited by examiner

LED STRIP, LED LUMINAIRE, AND A METHOD OF MANUFACTURING THEREOF

CROSS-REFERENCE TO PRIOR APPLICATIONS

This application is the U.S. National Phase application under 35 U.S.C. § 371 of International Application No. PCT/EP2015/070418, filed on Sep. 8, 2015, which claims the benefit of European Patent Application No. 14184517.2, filed on Sep. 12, 2014. These applications are hereby incorporated by reference herein.

FIELD OF THE INVENTION

The invention relates to lighting assembly for emitting substantially white light of a controllable correlated color temperature, a LED strip, a luminaire and a method of manufacturing the lighting assembly.

BACKGROUND OF THE INVENTION

Published patent application US2008/0238335A1, which is incorporated by reference, discloses in one specific embodiment a solid state light source comprising three Light Emitting Diodes (LEDs), a controller to control a light emission of the three LEDs and a photodetector. Two of the LEDs comprise the same type of blue emitting LED die and they both comprise the same type of (yellow emitting) luminescent material, but in other quantities. These two LEDs both have a color point not far away from the black body line one of the two color points is above the black body line and one of the two color points is below the black body line. The third LED is configured to emit green light. The document discloses that the light emission of the third LED is a combination of light emitted by a LED die and one or more luminescent materials. The controller receives from the photo detector a signal that indicates characteristics of the light emitted by the solid state light source. Subsequently the controller controls the individual light emissions of the LEDs to obtain a required light emission by the solid state light source which is a predefined or controllable point on the black body line.

A disadvantage of the embodiment of the cited patent application is that the color points of two LEDs, which have their color points close to the black body line, are on a line between a color point of the blue emitting LED die and a color point of the light emitted by the specific luminescent material. In such a situation it is impossible to select the two LEDs such that their color point are close to the black body line and such that a wide range of correlated color temperatures can be emitted by the solid state light source. Thus, only a small portion of the black body line is within a triangle defined by the color points of all three LEDs. Also the fact that one of the color points of one of the two LEDs is above the black body line contributes to the fact that a relatively small portion of the black body line is in a triangle defined by the color points of all three LEDs.

SUMMARY OF THE INVENTION

It is an object of the invention to provide a lighting assembly that is capable of emitting light that has a color point close to the black body line along a relatively wide range of correlated color temperatures.

An aspect of the invention provides a lighting assembly for emitting substantially white light of a controllable correlated color temperature. Other aspects of the invention provide a LED strip, a luminaire and a method of manufacturing a lighting assembly. Advantageous embodiments are defined in the dependent claims.

A lighting assembly for emitting substantially white light of a controllable correlated color temperature in accordance with an aspect of the invention comprises a plurality of groups of light sources and a controller. Each group of light sources comprises a first light source, a second light source and a third light source. The first light sources are for emitting first light that has a first color point and a first correlated color temperature. The first color point is within 7 SDCM (Standard Deviation of Color Matching) from a black body line. The first correlated color temperature being larger than 5000 Kelvin. The second light sources are for emitting second light that has a second color point and a second correlated color temperature. The second color point is within 7 SDCM from the black body line. The second correlated color temperature is smaller than 2250 Kelvin. The third light sources are for emitting greenish light. The greenish light has a third color point in the CIE 1931 XYZ color space within an intersection of half spaces $y>=1.04\ x$ and $y>=-0.0694x+0.4524$. Each third light source is capable of emitting a specific maximum flux of light under the predefined standard operation conditions. The specific maximum flux of each individual third light source maximally deviates 35% from an average maximum flux of all third light sources of the plurality of groups and the specific maximum flux of at least one of the third light sources deviates more than 10% from the average maximum flux. The controller is for generating a first control signal, a second control signal and a third control signal for said light sources. The first light sources of the plurality of groups are controlled by the first control signal. The second light sources of the plurality of groups are controlled by the second control signal. The third light sources of the plurality of groups are controlled by the third control signal. The first control signal, the second control signal and the third control signal indicate an amount of light to be emitted by the first light sources, the second light sources and the third light sources, respectively. The controller is configured to generate said respective control signals to obtain, in use, a combined light emission comprising the first light, the second light and the third light. The combined light emission having a controllable color point close to the black body line.

The color points of the first light source and the second light source are spaced apart from each other along by a relatively wide correlated color temperature range. When subsequently the third light source has its color point in the claimed area of the CIE 1931 XYZ color space, the triangle between the respective color points is relatively large and a large portion of the black body line falls within this triangle. As such, when the controller controls the light sources to emit light such that a combined light emission has a color point close to the black body line, substantially white light can be emitted by the lighting assembly along a relatively large range of correlated color temperatures. The range of correlated color temperatures that can be emitted by the light source assembly will be substantially equal to a range from the first correlated color temperature towards the second correlated color temperature.

During production of the third light sources the manufacturer obtains, in general, a relatively large deviation in the maximum flux of the third light sources. In most application such a large deviation of maximum fluxes is not acceptable, because it might lead to visible color hints or visible color differences—traditionally, the manufactured third light sources are tested and binned into bins that have per bin a relatively low spread in the maximum flux emitted by the third light sources of the bin. The inventors have found that, when the specific maximum flux of the third light sources deviate quite a lot from each other, for example, less than 35% from the average of all used third light sources, and by using a single controller to control the light sources of all groups, each group still emits combined light that has a color point close to the black body line. It has been proven by means of simulations that the color point of each group is at least within 15 SDCM from the black body line, and even more may be within 5 SDCM from the black body line. Thus, the human naked eye will experience the light that is emitted by each group as substantially white light. Thus, the inventors have found that it is not necessary to bin the third light sources, or that it is at least not necessary to bin them into a very large number of bins. Thereby, when manufacturing a lighting assembly according to this optional embodiment, cheaper third light sources can be used and, thus, the manufacturing cost of the lighting assembly is lowered. In particular when the third light sources emit the earlier discussed green light, this relatively large maximum flux variation can be accepted.

The third light source may also have a variation in their color point. In one of the later optional embodiments, areas of the color space are indicated in which the color points may be located. Also with respect to the color point the controller only knows the average color point as indicated by the manufacturer. Optionally, the color points of the third light sources may slightly deviate as well, e.g. within an area of 5 SDCM around a specific color point in the CIEXYZ color space. Subsequently, the controller has knowledge about this specific color point but not of each color point of each individual third light source.

Another advantage is that the light emissions of the first light sources and the second light sources comprise light energy at a relatively large number of wavelengths and, as such, the combined light emission has a relatively large Color Rending Index (CRI).

Given the specification of the discussed light sources, it is relatively easy to find light sources that fulfill the specifications. Today many embodiments of such light sources can be bought at the market at relatively low prices. Thus, the lighting assembly may be manufactured relatively cost effective.

The controller has knowledge about the color point of the light emitted by the first light sources, the second light sources and the third light sources. The controller also knows what the (average) maximum flux is of these light sources when being operated under predefined normal/standard operation condition. This information may be stored in a memory of the controller and this information is used by the controller to determine the control signals. Known controlling techniques may be used that are capable of controlling light sources on basis of knowledge about color points, maximum fluxes and a required controllable color point. The control signals indicate, for example, that the respective controlled light sources have to emit light at a specific percentage of their maximum flux—such information may also be expressed as a duty cycle value when the light sources are driven by a pulse width modulation technology. The control signal can be analogue or digital signals that are provided to driving circuitries which drive the light sources. The control signals may also be directly provided to the light sources when the controller is capable of generating signals that are powerful enough to drive the light sources. The controller may have an input for receiving information about the required controllable color point. When the controller knows at which required correlated color temperature light must be emitted a specific ratio between first and second light is determined to obtain a light emission having a combined color point on a line between the first color point and the second color point that is close to a color point on the black body line having the required correlated color temperature. The combined color point on the line is in most cases too far below the black body line. Subsequently the controller determines which amount of green light must be emitted to move the color point of the combined light emission towards the black body line.

It has to be noted that the controller does not know exactly how much greenish light each of the third light sources can maximally emit under the standard operation conditions. The controller has stored in its internal memory a value that is provided by the manufacturer as the average maximum flux for applied type of third light sources. In other words, when individual third light sources have a specific maximum flux that deviates from the average maximum flux, the controller has only knowledge about the average maximum flux and has no knowledge about the specific maximum flux of the individual third light sources. The specific maximum flux of each individual third light source maximally deviates 35% from this average value as supplied by the manufacturer.

It is to be noted that the above lighting assembly is capable of emitting substantially white light. Substantially white light means that this light has a color point that is close to the black body line—at least the color point is close enough to the black body line that the human naked eye experiences this light as white light and does not experience a hint of a color in the substantially white light. Thus, it means that the color point of the combined light emission is within 15 SDCM (Standard Deviation Color Matching) from the black body line, preferably within 10 SDCM from the back body line, more preferably within 5 SDCM from the black body line.

The predefined standard operation conditions comprise, for example, a predefined voltage that should be provided to the light source, or a predefined current, and the predefined standard operation conditions may include conditions relating to the ambient temperature and cooling means coupled to the light sources.

Optionally, the first color point is within 5 SDCM from the black body line. Optionally, the first color point is within 4 SDCM from the black body line. Optionally, the second color point is within 5 SDCM from the black body line. Optionally, the second color point is within 4 SDCM from the black body line. These optional embodiments ensure that the triangle between the first color point, the second color point and the third color point has a position within the color space such that a relatively large portion of the black body line is within the triangle. Consequently, the lighting assembly may optimally use the respective light sources to emit substantially white light within a relatively wide range of correlated color temperatures. Optionally, the second color point is within 3 SDCM from the black body line, resulting in a color point that is almost on the black body line.

Optionally, the first correlated color temperature is larger than or equal to 6000 Kelvin. Optionally, the first correlated color temperature is larger than or equal to 6500 Kelvin. Optionally, the first correlated color temperature is smaller than or equal to 100,000 Kelvin. Optionally, the first correlated color temperature is smaller than or equal to 50,000 Kelvin. Optionally, the second correlated color temperature is smaller than or equal to 2100 Kelvin. Optionally, the second correlated color temperature is smaller than or equal to 2000 Kelvin. Optionally, the second correlated color temperature is larger than or equal to 1000 Kelvin. These optional embodiments contribute to an even larger range of correlated color temperatures at which the lighting assembly may emit light.

Optionally, the specific maximum flux of each individual third light source maximally deviates 25% from an average maximum flux of all third light sources of the plurality of groups. Optionally, the specific maximum flux of each individual third light source maximally deviates 15% from an average maximum flux of all third light sources of the plurality of groups. These optional embodiment contribute to the fact that, per group, the emitted light will be more equal.

Optionally, the specific maximum flux of the at least one of the third light sources deviates more than 14% from the average maximum flux.

Optionally, each one of the third light sources comprises one of a green emitting solid state light emitter die and a solid state light emitter provided with luminescent material. With respect to the second embodiment of the third light source, the luminescent material is configured to convert a portion of the light emitted by the solid state light emitter towards light of another color—then the greenish light is a combination of another portion of the light emitted by the solid state light emitter and the light of the another color as emitted by the luminescent material. By means of such third light sources it is relatively easy to emit greenish light that has the third color point. With respect to the embodiment with the luminescent material, it has to be noted that the luminescent material may be one single luminescent material, but may also be a mix of luminescent materials. The luminescent material may be provided directly on top of the solid state light emitter or arranged at a short distance away from the solid state light emitter. The solid state light emitter may emit, for example, blue light and a portion of the blue light is converted by the luminescent material(s) towards light having a green and/or yellow color such that the combined emission of the not converted blue light in combination with the green and/or yellow light has the third color point. Optionally, all third light sources comprise the same one of the above discussed options.

A color point of green light emitted by a green emitting solid state light emitter dies may be located in an area around the color point (x, y)=(0.161, 0.715). When such a green emitting solid state light emitter die is used, only a small flux must be emitted by third light sources to obtain for the combined light emission a color point on or close to the black body line. Thus, the amount of energy used in addition to the light emission of the first light sources and the second light sources to obtain the (required) controllable color point is relatively low. Thus, the third light sources may also be relatively cheap because it is not required that it is capable of emitting large fluxes of light.

Today many light sources are available on the market that emit a lime color of light—such a light source is often based on a blue emitting LED and one or two luminescent materials that convert about all blue light emitted by the blue emitting LED. The light of the lime color has a color point in a region around the color point (x, y)=(0.408, 0.538). Also many other types of light sources are available that emit slightly off-white light that has a hint of green. Such greenish off-white light source are often also based on a blue emitting LED in combination with one or more luminescent materials that only convert a portion of the blue light—the used luminescent materials are often equal to the material used in the lime-color emitting light source but are applied in another quantity. A typical color point of the off-white light sources is within an area around the color point (x, y)=(0.376, 0.454). An advantage of using lime color emitting light sources or using off-white light emitting light source is that their light emission spectrum have at a relatively large number of wavelengths light, and, thus such light sources may contribute to a larger CRI of the combined light emission.

It is to be noted that individual third light sources may comprise a plurality of green emitting solid state light emitter dies or a plurality of solid state light emitters provided with a luminescent material, or the third light sources may even comprise a combination of both of them.

Optionally, the third color points of the third light sources, in the CIE 1931 XYZ color space, are within one of the following areas:

a first area defined by a polygon of which the corners are the color points (x,y)=(0.129, 0.740), (x,y)=(0.238, 0.740), (x,y)=(0.243, 0.700) and (x,y)=(0.146, 0.696), a second area defined by a polygon of which the corners are the color points (x,y)=(0.382, 0.506), (x,y)=(0.397, 0.499), (x,y)=(0.434, 0.567) and (x,y)=(0.421, 0.582), a third area defined by a polygon of which the corners are the color points (x,y)=(0.388, 0.496), (x,y)=(0.401, 0.487), (x,y)=(0.365, 0.415) and (x,y)=(0.350, 0.420).

The first area relates to light emitted by green light emitting solid state light emitter dies. The second area related to third light sources emitting lime colored light. The third area relates to third light source emitting greenish off-white light. Optionally, all third light sources have a color point in the same area selected from the above described first area, second are and third area.

Optionally, for the individual groups of the plurality of groups, a maximum flux that can be emitted by the third light source of a specific group, under the predefined standard operation conditions, is smaller than 50% of the sum of the maximum fluxes that can be emitted by the first light source of the specific group and the second light source of the specific group under the predefined standard operation conditions. Thus, the third light sources doesn't have to be very powerful and, when for example the light sources comprises a plurality of solid state light emitters, a relatively low number of solid state light emitters have to be used in the third light sources. This optional embodiment relates to all earlier discussed embodiments of the third light sources.

Optionally, for individual groups of the plurality of groups, the maximum flux that can be emitted by the third light source of a specific group, under the predefined standard operation conditions, is smaller than 35% of the sum of the maximum fluxes that can be emitted by the first light source of the specific group and the second light source of the specific group under the predefined standard operation conditions. This optional embodiment mainly relates to the earlier discussed third light sources that emit lime colored light or comprise a green light emitting solid state light emitter die.

Optionally, for individual groups of the plurality of groups, the maximum flux that can be emitted by the third light source of a specific group, under the predefined standard operation conditions, is smaller than 20% of the sum of the maximum fluxes that can be emitted by the first light source of the specific group and the second light source of the specific group under the predefined standard operation conditions. This optional embodiment mainly relates to the earlier discussed third light sources that comprise a green light emitting solid state light emitter die.

Optionally, at least one of the first light sources and the second light sources comprises a solid state light emitter. Optionally, both the first light sources and the second light sources comprise a solid state light emitter. Optionally, at least one of the first light sources and the second light sources comprises a plurality of solid state light sources. Optionally, the solid state light emitters used in the different light sources may be the same type of solid state light emitters and, for example, different compositions of luminescent materials are used to obtain different light emission for the different light sources. Examples of solid state light emitters are Light Emitting Diodes (LEDs), Organic Light Emitting diode(s) OLEDs, or, for example, laser diodes. In some embodiments the solid state light sources may be a blue light emitting LEDs, such as GaN or InGaN based LEDs, for example emitting primary (blue) light of the wavelength range from 440 to 460 nm. A portion of such blue light may subsequently be converted by luminescent material to light of a higher wavelength. Alternatively, the solid state light sources may emit UV or violet light which is subsequently converted into light of longer wavelength(s) by one or more luminescent materials.

Optionally, the first light sources comprise a first luminescent material and/or the second light sources comprise second luminescent material. The first luminescent material is configured to convert a portion of the light emitted by a light emitter of the first light source towards light of a first other color and the first light is a combination of another portion of the light emitted by the light emitter of the first light source and the light of the first other color as emitted by the first luminescent material. The second luminescent material is configured to convert a portion of the light emitted by a light emitter of the second light source towards light of a second other color and the second light is a combination of another portion of the light emitted by the light emitter of the second light source and the light of the second other color as emitted by the second luminescent material. The first luminescent material and the second luminescent material is then a single luminescent compound, but may also be a mix of different luminescent compounds. The first luminescent material may be equal to the second luminescent material but may be applied in a different relative quantity (with respect to the amount of emitted light of the respective light source). The first luminescent material may have a different composition than the second luminescent material. The compositions and amounts of luminescent material is carefully selected in combination with a selection of a specific light emitter in the light source(s) such that the color point of the light emitted by the light source(s) has the color point and correlated color temperature as discussed above. Several light sources based on LEDs in combination with specific compositions of luminescent materials for use in the lighting assembly are commercially available.

Optionally, each first light source is capable of emitting a further specific maximum flux of light under the predefined standard operation conditions. The further specific maximum flux of each individual first light source maximally deviates 20% from a further average flux of all first light sources of the plurality of groups. The further specific maximum flux of at least one of the first light sources deviates more than 7.5% from the further average maximum flux. Thus, in the lighting assembly according to this optional embodiment, it is also not necessary to bin the first light sources before being assembled into the lighting assembly and a relatively large manufacturing variety can be accepted. Optionally, the further specific maximum flux of each individual first light source maximally deviates 15% from a further average flux of all first light sources of the plurality of groups. Optionally, the further specific maximum flux of at least one of the first light sources deviates more than 10% from the further average maximum flux. In line with a discussion in the context of the third light source, the controller does not have knowledge about the exact parameters of each individual first light source, but has only knowledge of the average of each parameter.

Optionally, each second light source is capable of emitting another specific maximum flux of light under the predefined standard operation conditions. The another specific maximum flux of each individual second light source maximally deviates 20% from another average flux of all second light sources of the plurality of groups. The another specific maximum flux of at least one of the second light sources deviates more than 7.5% from the another average maximum flux. Thus, in the lighting assembly according to this optional embodiment, it is also not necessary to bin the second light sources before being assembled into the lighting assembly and a relatively large manufacturing variety can be accepted for the second light sources. Optionally, the further specific maximum flux of each individual second light source maximally deviates 15% from a further average flux of all second light sources of the plurality of groups. Optionally, the another specific maximum flux of at least one of the second light sources deviates more than 10% from the another average maximum flux. In line with a discussion in the context of the second light source, the controller does not have knowledge about the exact parameters of each individual second light source, but has only knowledge of the average of each parameter.

According to another aspect of the invention, a LED strip is provided that comprises the lighting assembly according to the above discussed embodiments of the lighting assembly. Optionally, the first light sources, the second light source and the third light sources are Light Emitting Diodes (LEDs). The LED strips of this optional embodiment can be manufactured more efficiently because the light sources used in the LED strips do not have to be binned before being assembled into the LED strips. Furthermore, LED strips are often arranged to be coupled to each other to form even longer strips with LEDs. The inventors have found that also between the LED strips the manufacturing variety between the light sources can be accepted, such that, for example, a LED strip manufactured with LEDs from a certain manufacturing batch can be combined with another LED strip manufactured with LEDs from another manufacturing batch. It is to be noted that the LED strip has at least an elongated shape and comprises the plurality of groups of the first, second and third light source and comprises the controller.

The LED strip according to another aspect of the invention provides the same benefits as the lighting assembly according to the first aspect of the invention and has similar embodiments with similar effects as the corresponding embodiments of the lighting assembly.

Optionally, the light sources of the LED strip are provided on a flexible strip-shaped support. Strip shaped means that it has an elongated shape. The flexible strip-shaped support may comprises electrically conductive tracks for providing power and signals provided by the controller and/or a driving circuitry to the different light sources.

According to a further aspect of the invention, a luminaire is provide that comprises a lighting assembly according to one of the previous embodiments. The luminaire according to the further aspect of the invention provides the same benefits as the lighting assembly according to the first aspect of the invention and has similar embodiments with similar effects as the corresponding embodiments of the lighting assembly.

Optionally, the luminaire is arranged to emit light from a plurality of spatially separated locations. At the plurality of spatially separated locations at least one group of light sources is provided. Optionally, the luminaire is arranged to emit a light beam from the spatially separated location having at least one group of light source. As discussed before, manufacturing tolerances can be accepted between the light sources of the different groups when all the groups are controlled by a single controller that provides equal control signals to light sources of a single type (e.g. one control signal for all first light sources). When the luminaire emits a plurality of light beams, slight differences in the color point of the light emitted by each group are less visible and, thus, relatively large deviations in characteristics of the light sources can be accepted, such as relatively large deviations in the maximum flux that they emit.

According to a last aspect of the invention, a method of manufacturing a lighting assembly comprising a plurality of groups of a first light source, a second light source and a third light source is provided.

The method comprises receiving a set of first light sources. The first light sources are configured to emit first light having a first color point and a first correlated color temperature. The first color point is within 7 SDCM from a black body line. The first correlated color temperature being higher than 5000 Kelvin.

The method further comprises receiving a set of second light sources. The second light sources are configured to emit second light having a second color point and a second correlated color temperature. The second color point is within 7 SDCM from a black body line. The second correlated color temperature is lower than 2250 Kelvin.

The method also comprises receiving a set of third light sources. The third light sources are configured to emit greenish light having a third color point in the CIE 1931 XYZ color space within an intersection of half spaces $y>=1.04\ x$ and $y>=-0.0694x+0.4525$. Each third light source is capable of emitting a specific maximum flux of light under the predefined standard operation conditions. The specific maximum flux of each individual third light source maximally deviates 35% from an average maximum flux of all the third light sources of the set of third light sources and the specific maximum flux of at least one of the third light sources deviates more than 10% from the average maximum flux.

The method further comprises forming groups of light source. Each one of the groups comprises a first light source of the set of first light sources, a second light source of the set of second light sources and a third light source of the groups of light sources.

The method also comprises assembling the groups of light sources into the lighting assembly.

The method comprises assembling a controller into the lighting assembly and coupling it to the light sources of the groups of light sources. The controller is configured to generate a first control signal for controlling the first light sources, a second control signal for controlling the second light sources and a third control signal for controlling the third light sources, wherein the first control signal, the second control signal and the third control signal indicate an amount of light to be emitted by the first light sources, the second light sources and the third light sources, respectively. The controller is configured to generate said respective control signals to obtain, in use, a combined light emission comprising the first light, the second light and the third light. The combined light emission has a controllable color point close to the black body line and having a correlated color.

The method according to this aspect of the invention provides the same benefits as the previously discussed lighting assembly and has similar embodiments with similar effects as the corresponding embodiments of the lighting assembly.

These and other aspects of the invention are apparent from and will be elucidated with reference to the embodiments described hereinafter.

It will be appreciated by those skilled in the art that two or more of the above-mentioned options, implementations, and/or aspects of the invention may be combined in any way deemed useful.

Modifications and variations of the lighting assembly, the LED strip, the luminaire and/or the method which correspond to the described modifications and variations of the lighting assembly, can be carried out by a person skilled in the art on the basis of the present description.

Figure 1A:
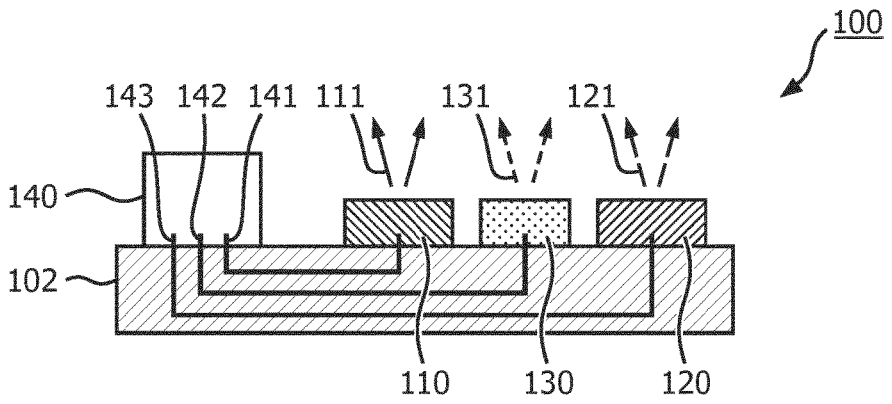
FIG. 1*a* schematically shows in a cross-sectional view an embodiment of a lighting assembly, FIG. 1*b* schematically shows a CIE 1931 XYZ color space in which color points of light sources of the lighting assembly are schematically indicated, FIG. 2*a* schematically shows a top view of an embodiment of a LED strip, FIG. 2*b* schematically shows an embodiment of a luminaire, FIG. 3 schematically shows a method of manufacturing a lighting assembly.

It should be noted that items denoted by the same reference numerals in different Figures have the same structural features and the same functions, or are the same signals. Where the function and/or structure of such an item have been explained, there is no necessity for repeated explanation thereof in the detailed description.

The Figures are purely diagrammatic and not drawn to scale. Particularly for clarity, some dimensions are exaggerated strongly.

DETAILED DESCRIPTION

A first embodiment is shown in FIG. 1*a*. FIG. 1*a* schematically shows in a cross-sectional view an embodiment of a lighting assembly 100. The lighting assembly 100 comprises a controller 140, a first light source 110, a second light source 120 and a third light source 130. The controller 140, the first light source 110, the second light source 120 and the third light source 130 are optionally provided on a support 102, such as, for example, a printed circuit board. Optionally, the lighting assembly 100 comprises a housing (not shown) which comprises a light exit window (not shown) through which, in use, the first light source 110, the second light source 120 and/or the third light source 130 emit light.

The first light source 110 is configured to emit first light 111 having a first color point and a first correlated color temperature. The first color point is a color point in a specific color space, for example, the CIE 1931 XYZ color space. In the color space a black body line represents color points of light emissions of black body radiators having different temperatures. The first color point is within 7 SDCM (Standard Deviation Colour Matching) from the black body line. The first correlated color temperature is larger than 5000 Kelvin, for example, 5500 Kelvin, 6000 Kelvin or 6300 Kelvin. Optionally, the first correlated color temperature is larger than 6000 Kelvin. Thus, the first light 111 is substantially white light of a relatively high correlated color temperature. One often refers to this light with the term "cold white light".

Optionally, the first light source 110 comprises a solid state light emitter (not shown separately) that emits, for example, blue light and comprises luminescent material (not shown separately) that converts at least a portion of the light emitted by the solid state light emitter towards light of another color, for example, yellow and/or orange light. A specific amount of luminescent material is selected such that a combination of a portion of the light emitted by the solid state light emitter that is not absorbed and the emitted light of the another color results in the first light 111 having the above discussed characteristics. Optionally, the first light source 110 comprises a plurality of solid state light emitters which are each, optionally, provided with a luminescent material. The above discussed luminescent material may be a single luminescent material or a mix of luminescent materials. Today one can easily buy Light Emitting Diodes (LEDs) provided with a luminescent material such that the combination has the characteristics of the first light source 110. In another embodiment, the first light source 110 may also comprise a plurality of solid state light emitters that are optionally provided with the luminescent material—the combined light emission of these plurality of solid state light emitters fulfill the above discussed requirements for the light emission of the first light source 110.

The second light source 120 is configured to emit second light 121 having a second color point and a second correlated color temperature. The second color point is a color point in a specific color space, for example, the CIE 1931 XYZ color space. The second color point is within 7 SDCM (Standard Deviation Colour Matching) from the black body line. The second correlated color temperature is smaller than 2250 Kelvin, for example, 2150 Kelvin, 2100 Kelvin or 2200 Kelvin. Optionally, the second correlated color temperature is smaller than 2100 Kelvin. Thus, the second light 121 is substantially white light of a relatively low correlated color temperature. One often refers to this light with the term "warm white light".

Optionally, the second light source 120 comprises a solid state light emitter (not shown separately) that emits, for example, blue light and comprises luminescent material (not shown separately) that converts at least a portion of the light emitted by the solid state light emitter towards light of a further color, for example, yellow and/or orange light. A specific amount of luminescent material is selected such that a combination of a portion of the light emitted by the solid state light emitter that is not absorbed and the emitted light of the further color results in the second light 121 having the above discussed characteristics. Optionally, the second light source 120 comprises a plurality of solid state light emitters which are each, optionally, provided with the luminescent material. The above discussed luminescent material may be a single luminescent material or a mix of luminescent materials. Today one can easily buy Light Emitting Diodes (LEDs) provided with a luminescent material such that the combination has the characteristics of the second light source 120. In another embodiment, the second light source 120 may also comprise a plurality of solid state light emitters that are optionally provided with the luminescent material—the combined light emission of these plurality of solid state light emitters fulfill the above discussed requirements for the light emission of the second light source 120.

The third light source 130 is configured to emit greenish light 131. The greenish light has a third color point in the CIE 1931 XYZ color space that is within an area that is an intersection of half spaces $y>=1.04\ x$ and $y>=-0.0694x+0.4524$. The area that is the intersection relates to color point of light emissions that have at least a green color component, and, thus, relate to greenish light. The term greenish light is, in the context of this document, thus defined by means of the area of the CIE 1931 XYZ color space.

Optionally, the third light source 130 comprises a solid state light emitter die that emits green light—then the third color point has a y-value that is larger than 0.65 and relates, thus, to about pure, intense green light. The third light source 130 may comprise a plurality of such green light emitting solid state light emitter dies.

Optionally, the third light source 130 comprises a solid state light emitter (not shown separately) that emits light of a specific color such as, for example, blue light, and comprises luminescent material (now shown separately) that converts at least a portion of the light emitted by the solid state light emitter towards light of another color, for example, green or lime light. A specific amount of luminescent material is selected such that a combination of a portion of the light emitted by the solid state light emitter that is not absorbed and the emitted light of the another color results in the third light 131 having the above discussed characteristics. Optionally, the third light source 130 comprises a plurality of solid state light emitters which are each, optionally, provided with the luminescent material. The above discussed luminescent material may be a single luminescent material or a mix of luminescent materials.

The controller 140 is configured to generate, in use, a first control signal 141, a second control signal 142 and a third control signal 143 for controlling a light emission of the above discussed light sources 110, 120, 130. The first control signal 141, the second control signal 142 and the third control signal 143 indicate an amount of light to be emitted by the first light source 110, the second light source 120 and the third light source 130, respectively. The controller is configured to generated the control signals such that, when the light sources 110, 120, 130 are controlled by the control signal 141, 142, 143, the lighting assembly emits a combined light emission that has a color point close to the black body line. The controller is configured to control the position of the color point such that the correlated color temperature of the combined light emission is controlled. Known light source controlling technologies may be implemented in the control 140. Such technologies are today implemented in color tunable lighting devices, such as, for example, the Philips Hue® lamp. The controller 140 received previously (for example, during or directly after manufacturing) some information about the characteristics of the light sources 110, 120, 130 such as their (estimated) color point and the (estimated) maximum flux they can emit. This information is used to control the light emission of the light source 110, 120, 130, e.g. by controlling at which percentage of their maximum flux they have to emit light, such that a specific amount of cold white light, a specific amount of warm white light and a specific amount of greenish light is emitted that together have a color point on or close to the black body line. The controller 140 has, for example, also an input at which it receives a signal that indicates at which correlated color temperature (in between the first color temperature and the second color temperature) the lighting assembly has to emit substantially white light. This input is used by the controller 140 to determine in which ratio the first light and the second light must be mixed (which would result in a color point that is located below the black body line) and how much greenish light must be emitted to move the color point of the combined light emission into an upwards direction to a position close to or on the black body line. Thereby the lighting assembly is capable of emitting substantially white light along a relatively large range of correlated color temperature, e.g. from the first color temperature to the second color temperature.

FIG. 1*a* shows the lighting assembly 100 without a housing. In practical embodiments, the lighting assembly 100 is provided in a housing (not shown), for example, a retrofit light bulb, and may also have other electronics like circuitries (not shown) for converting the mains input power towards a power signal of a lower voltage level.

Figure 1B:
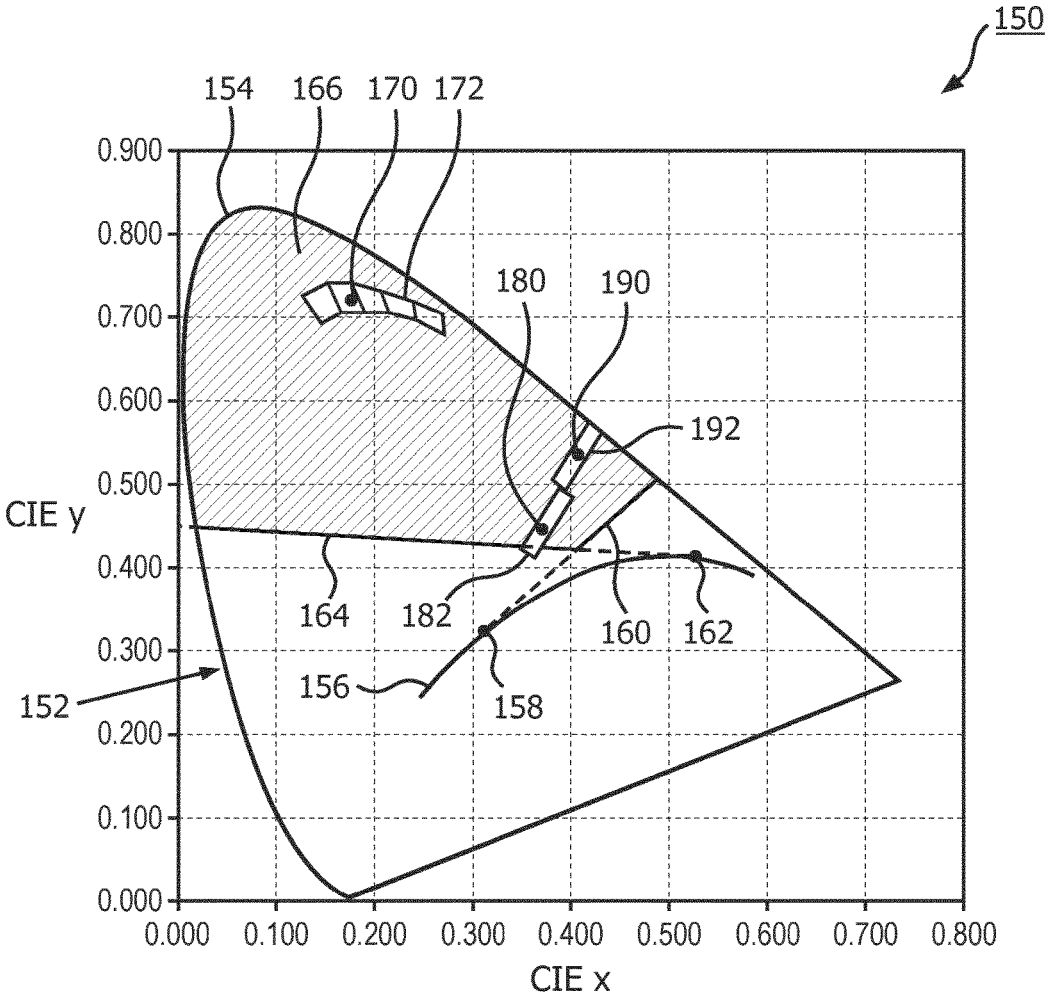

FIG. 1*b* schematically shows a CIE 1931 XYZ color space 152 in which color points of light sources of the lighting assembly are schematically indicated. In chart 150 is drawn the CIE 1931 XYZ color space 152. Line 154 is the mono line that represents color points of light emission spectra that comprise light energy at a single wavelength. In the color space 152 is also drawn the black body line 156. Color point 158 is an example of a color point of a previously discussed first light source. Color point 158 represents a light emission that has a correlated color temperature of 6500K and is located on or very close to the black body line 156 (which means: at least within 7 SDCM from the black body line 156). Color point 162 is an example of a color point of a previously discussed second light source. Color point 162 represents a light emission that has a correlated color temperature of 2000K and is located on or very close to the black body line 156 (which means: at least within 7 SDCM from the black body line 156).

The color point of the third light source is within area 166. Area 166 is a sub-area of the whole color space 152 and is located above both lines y=1.04 x and y=−0.0694 x+0.4525. In other words, the area 166 is the intersection of half space y>=1.04 x and y>=−0.0694x+0.4524 (and the CIE 1931 XYZ color space 152). Thus, area 166 represents color point of greenish light.

In an embodiment, the third light source is a green emitting solid state light emitter die. This is, for example, color point 170 that has as coordinates (x, y)=(0.181, 0.715). In an embodiment, the third color point is within an area 172 as indicated in FIG. 1*b*. Optionally, the area 172 is defined by a polygon of which the corner points are: (x,y)=(0.129, 0.740), (x,y)=(0.238, 0.740), (x,y)=(0.243, 0.700) and (x,y)=(0.146, 0.696).

In an embodiment, the third light source emits lime-color light. Such a light emission may be obtained by combining a solid state light emitter with suitable luminescent materials. A color point of such a light source may be the color point 190 that has as coordinates (x, y)=(0.408, 0.538). In an embodiment, when the third light source emits lime colored light, the third color point is within an area 192 as indicated in FIG. 1*b*. Optionally, the area 192 is defined by a polygon of which the corner points are: (x,y)=(0.382, 0.506), (x,y)=(0.397, 0.499), (x,y)=(0.434, 0.567) and (x,y)=(0.421, 0.582).

In an embodiment, the third light source emits off-white light that has a hint of green when seen by the human naked eye. Later in this application the color of this light is indicated by greenish off-white light. Such a light emission may be obtained by combining a solid state light emitter with suitable luminescent materials. A color point of such a light source may be the color point 180 that has as coordinates (x, y)=(0.376, 0.454). In an embodiment, when the third light source emits greenish off-white light, the third color point is within an area 182 as indicated in FIG. 1*b*. Optionally, the area 182 is defined by a polygon of which the corner points are: (x,y)=(0.388, 0.496), (x,y)=(0.401, 0.487), (x,y)=(0.365, 0.415) and (x,y)=(0.350, 0.420).

In FIG. 1*b* it can be seen that when the first light source and the second light source both emit a specific amount of light, the combined light emission will have a color point away from the black body line (which is a point of a straight line through color points 158, 162). Thus, by also emitting a specific amount of greenish light (having a color point in the area 166), the color point of the combined light emission of the first to the third light source moves towards the black body line 156. The controller controls the amount of emitted greenish light (on basis of knowledge of the required color point on the black body line) such that the color point of the combined light emission is close to the black body line, e.g. within 7 SDCM from the black body line.

Each one of the light source 110, 120, 130 is, under predefined standard operational conditions, capable of emitting about a specific maximum flux. It might be that the manufacturer indicates what, for each individual light source 110, 120, 130, the specific maximum flux is and it may be that the manufacturer only indicates for the light sources 110, 120, 130 a maximum flux value that represents the average of the maximum fluxes of those types of light sources. The maximum fluxes that can be emitted by individually provided light source 110, 120, 130 may deviate (within some limits) from the indicated maximum fluxes. In general a specific first light source 110 and a specific second light source 120 is selected such that the lighting assembly is capable of emitting substantially white light at a combined predefined maximum flux. As discussed earlier, the third light source has to emit an amount of greenish light that is enough to correct the light emission of the first and second light source such that the combined light emission has a color point on the black body line. To obtain this correction, the third light source may be less powerful than the first light source and the second light source. Simulations have shown that when the third light source 130 is a green emitting solid state light emitter die, the maximum flux of the third light source 130 is about 13% of the sum of the maximum flux of the first light source 110 and the maximum flux of the second light source 120. It was also shown that, when the third light emitter 130 emits, as discussed in the context of FIG. 1*b*, lime light, the maximum flux of the third light source 130 is about 28% of the sum of the maximum flux of the first light source 110 and the maximum flux of the second light source 120. It was further shown by means of simulations that, when the third light source 130 emits, as discussed in the context of FIG. 1*b*, greenish off-white light, the maximum flux of the third light source 130 is about 43% of the sum of the maximum flux of the first light source 110 and the maximum flux of the second light source 120. Thus, the addition of the third light source 130 does not significantly increase costs because the third light source 130 does not have to be a very powerful light source (compared to the first light source and the second light source). If it is assumed that each light source comprises a plurality of Light Emitting Diodes (LEDs) (also comprising luminescent material for the first light source and the sec light source), LED count can also be used as an indication that less LEDs are required for the third light source than for the first light source and the second light source. When LED count is used as a parameter, it is assumed that the LEDs are of the same type of blue emitting LED dies and having about the same die size. Green emitting LED dies have about the same efficiency as the first and second light sources comprising LEDs and luminescent material. Thus, the LED count for the green emitting solid state light emitters is about 13% of the sum of the number of LEDs in the first and in the second light source. The third light sources emitting lime colored light or greenish off-white light are about 1.5 times more efficient than the first and second light sources. Thus, when the third light source emits lime colored light or greenish off-white light, the LED count for the third light sources is about 18% or 28%, respectively, of the sum of the LED counts of the first light source and the second light source. These numbers at least apply to lighting assembly that has a first light source that has a correlated color temperature of 6500 Kelvin and has a second light source that has a correlated color temperature of 2000 Kelvin.

Luminescent materials that may be used in the third light source may be one of: an organic phosphor, an inorganic phosphor, and particles showing quantum confinement and having at least in one dimension a size in the nanometer range, wherein examples of the particles are: quantum dots, quantum rods and quantum tetrapods.

More in particular, examples of suitable inorganic phosphors are:

$Lu_{1-x-y-a-b}Y_xGd_y)_3(Al_{1-z-u}Ga_zSi_u)_5O_{12-u}N_u:Ce_aPr_b$ wherein $0\leq x\leq 1$, $0\leq y\leq 1$, $0<z\leq 0.1$, $0\leq u\leq 0.2$, $0<a\leq 0.2$ and $0<b\leq 0.1$, such as $Lu_3Al_5O_{12}:Ce^{3+}$ and $Y_3Al_5O_{12}:Ce^{+}$, $(Sr_{1-a-b-c}Ca_bBa_c)Si_xN_yO_z:Eu_a^{2+}$ wherein a=0.002-0.2, b=0.0-0.25, c=0.0-1.0, x=1.5-2.5, y=0.67-2.5, z=1.5-4 including, for example, $SrSi_2N_2O_2:Eu^{2+}$ and $BaSi_2N_{0.67}O_4:Eu^{2+}$, $(Sr_{1-u-v-x}Mg_uCa_vBa_x)(Ga_{2-y-z}Al_yIn_zS_4):Eu^{2+}$ including, for example, $SrGa_2S_4:Eu^{2+}$, $(Sr_{1-x}Ba_x)_2SiO_4$:Eu, wherein $0<x\leq 1$, including, for example, $BaSrSiO_4:Eu^{2+}$, $(Ca_{1-x-y-a-b}Y_xLu_y)_3(Sc_{1-z}Al_z)_2(Si_{1-x-y}Al_{x-y})_3O_{12}:Ce_aPr_b$ wherein $0\leq x\leq 1$, $0\leq y\leq 1$, $0<z\leq 1$, $0\leq u\leq 0.2$, $0<a\leq 0.2$ and $0<b\leq 0.1$, such as $Ca_3Sc_2Si_3O_{12}:Ce^{3+}$.

Other examples of suitable inorganic luminescent materials are: SSONE ($SrSi_{(2)}N_{(2)}O_{(2)}$:Eu), SIAlON ($SrSi_{(2)}N_{(2)}O_{(2)}$:Eu), SAE ($Sr_4Al_{14}O_{25}$:Eu), GaYAG ($(Y_xGa_{(1-x)})_3Al_5O_{12}$:Eu), a lucid green quantum dot, BAM:Mn (BaMgAl10O17:Mn), BBG ($BaMgAl_{10}O17$:Eu,Mn), BSONE ($BaSi_{(2)}N_{(2)}O_{(2)}$:Eu), and different Silicates ($A_2Si(OD)_4$:Eu with A=Sr, Ba, Ca, Mg, Zn and D=F, Cl, S, N, Br; BOSE=(SrBaCa)2SiO4:Eu; (Ba2MgSi2O7:Eu2+; Ba2SiO4:Eu2+); (Ca,Ce)3(Sc,Mg)2Si3O12.

More in particular, examples of organic phosphors are green emitting organic dyes such as perylene derivatives such as Lumogen F materials 083 (yellow), 170 (yellow), 850 (green).

Suitable quantum dot are cadmium selenide (CdSe) with a shell such as cadmium sulfide (CdS) and zinc sulfide (ZnS), or cadmium free quantum dots such as indium phosphide (InP), and copper indium sulfide (CuInS2) and/or silver indium sulfide (AgInS2).

The third light source may have only luminescent materials that emit greenish light, but the third light source may also comprise small quantities of luminescent materials that emit reddish light—of course, the combination of light emitted by the third light source has to be in the area 166.

Figure 2A:
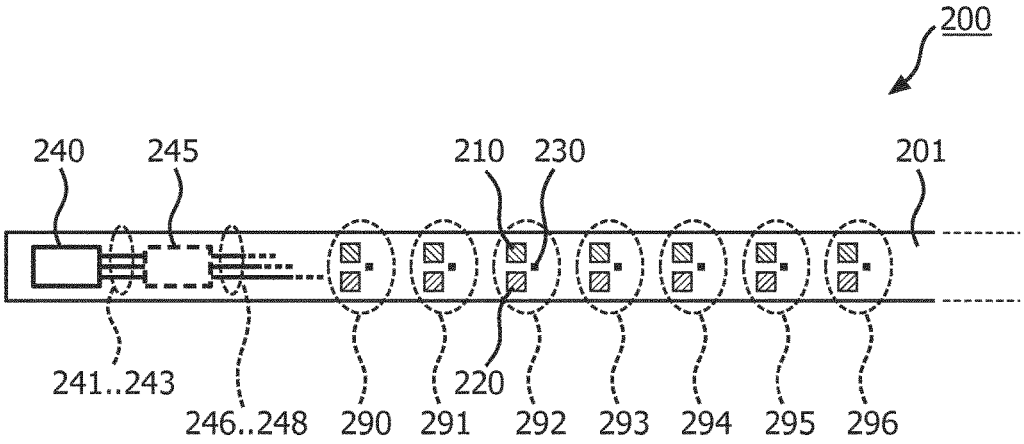

FIG. 2*a* schematically shows a top view of an embodiment of a LED strip 200. The LED strip 200 comprises a previously discussed lighting assembly. The lighting assembly of FIG. 1*a* comprises one first light source, one second light source and one third light source. In the LED strip 200 there are a plurality of first light sources 210, a plurality of second light sources 220 and a plurality of third light sources 230. Each one of these plurality of first light sources 210, second light sources 220 and third light sources 230 has characteristics as the first, second and third light source as discussed in the context of FIG. 1*a*. The light sources are subdivided in groups 290 . . . 296 of light sources. Each group 290 . . . 296 of light sources comprises a first light source 210, a second light source 220 and a third light source 230. In this embodiment, each one of the light sources 210, 220, 230 in each one of the groups 290 . . . 296 of light sources may comprise a Light Emitting Diode (LED), optionally provided with a luminescent material.

Each third light source is capable of emitting a specific maximum flux of light under predefined standard operation conditions, such as under a specific temperature, given a specific cooling of the third light source, and given a specific predefined supply voltage or supply current to the third light source. Often, light sources that are used are binned and have a limited variation in the specific maximum flux because manufacturers of LED strips believe that otherwise color differences are visible between the different groups 290 . . . 296 of light sources. Simulation have shown that in the specific use of the lighting assembly of this application, and more specifically in the context of lighting assemblies having a plurality of groups 290 . . . 296 of light source, much more variations can be accepted with respect to the characteristic "maximum flux emitted under predefined standard operation conditions". It has been shown that the specific maximum flux of each individual third light source 230 may maximally deviate 35% from an average maximum flux of all third light sources 230 of the plurality of groups 290 . . . 296 of light sources. It is to be noted that, it is assume that at least one of the third light sources 230 actually deviates from the average maximum flux with at least 10%. Thus, when a LED strip 200 is manufactured, the manufacturer of the third light sources does not have to bin the third light sources and, thus, the price of the third light source will be lower and, thus, the LED strip 200 can be manufactured at a lower cost price.

Optionally, each first light source 210 being capable of emitting a further specific maximum flux of light under the predefined standard operation conditions. The predefined standard operation conditions may be different for the first light sources 210 than the predefined standard operation conditions of the third light sources 230 when, for example, the first light sources 210 have to operate at another voltage or when another current must be applied to the first light sources 210. The further specific maximum flux of each individual first light source maximally deviates 20% from a further average flux of all first light sources 210 of the plurality of groups. It is assumed that the further specific maximum flux of at least one of the first light sources 210 deviates more than 7.5% from the further average maximum flux. Thus, it is also not necessary to bin the first light sources 210 in relatively small bins with respect to the characteristic maximum flux emitted under predefined standard operation conditions.

Optionally, each second light source 220 being capable of emitting another specific maximum flux of light under the predefined standard operation conditions. The predefined standard operation conditions may be different for the second light sources 220 than the predefined standard operation conditions of the third light sources 230 or of the second light sources 220 when, for example, the second light sources 220 have to operate at another voltage or when another current must be applied to the second light sources 220. The another specific maximum flux of each individual second light source 220 maximally deviates 20% from another average flux of all second light sources of the plurality of groups. It is also assumed that the another specific maximum flux of at least one of the second light 220 sources deviates more than 7.5% from the another average maximum flux. Thus, it is also not necessary to bin the second light sources 220 in relatively small bins with respect to the characteristic maximum flux emitted under predefined standard operation conditions.

The LED strip 200 comprises a controller 240 which has the same characteristics as the controller 140 of FIG. 1*a*. The controller 240 provides three control signals 241 . . . 243 for controlling an amount of light emitted by the first light sources 210, the second light sources 220 and the third light sources 230, respectively. The control signal 241 . . . 243 indicate, for example, which percentage of a maximum emittable flux of the respective light sources 210, 220, 230 must be emitted—such a value may optionally also be provided in the form of a duty-cycle value. The LED strip 200 optionally comprise a driving circuitry 245 which receives the control signal 241 . . . 243 and generates driving signal 246 . . . 248 for driving the light sources 210, 220, 230. In an embodiment, the driving circuitry 245 generates driving signals 246 . . . 248 that are modulated according to pulse width modulation technology. Each one of the first light sources 210 of each group 290 . . . 296 of light sources receives the same driving signal and is controlled in an equal way. Each one of the second light sources 220 of each group 290 . . . 296 of light sources receives the same driving signal and is controlled in an equal way. Each one of the third light sources 230 of each group 290 . . . 296 of light sources receives the same driving signal and is controlled in an equal way—it is to be noted that the third light source may have, with respect to the maximum flux they can emit, a relative large deviation and, thus, each one of the third light source 230 of each group 290 . . . 296 of light sources emits, in use, a slightly different flux. Simulations have shown that the combined light emission of each group 290 . . . 296 of light sources is within an acceptable threshold value from the black body line such that the human naked eye does not experience large differences between the combined light emission of each group 290 . . . 296. Thus, when the LED strip 200 is manufactured, it is not necessary to use binned third light source that are binned according to the characteristic "maximal emittable flux" under standard operation conditions.

The light sources 210, 220, 230 of each group 290 . . . 296, the controller 240 and the optional driving circuitry 245 may be provided on a flexible support strip 201. The flexible support strip 201 may comprise electrical conductive tracks for transporting driving signals 246 . . . 248 to the light sources 210, 220, 230.

In the above it has been assumed discussed that the specific maximum flux (or even the color point of the emitted light) of some of the light sources may deviate with respect to an average of these parameters for the light sources. In practical embodiments it means that the used light sources are not binned before being assembled in the LED strip, and, thus, that the values of their characteristics (like maximum flux under predefined operational conditions and/or color point of emitted light) deviate within a range that has a specific maximum and a specific minimum. The specific maximum and the specific minimum are space further apart than they would have been when the light sources were binned.

Please not that each group 290 . . . 296 of light source may comprise more than the first light source, the second light source and the third light source. For example, other light source or LEDs may also be provided in every group. In a specific embodiment, each group is build up by providing the first light source and second light source as described above and by providing a light source that comprises a green, a blue and a red emitting LED and at least the green emitting LED is controlled by the controller as discussed above.

Figure 2B:
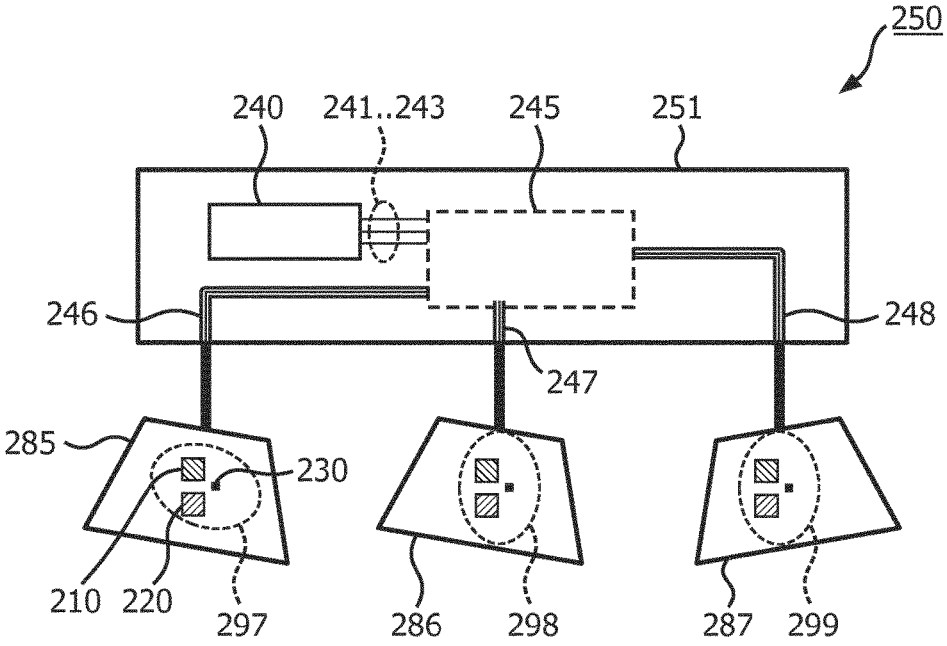

FIG. 2*b* schematically shows an embodiment of a luminaire 250. The luminaire comprises, for example, a housing 251 that may be coupled to a wall or a sealing of a room. The luminaire 250 comprises a controller 240 that generates, in use, control signal 241 . . . 243, an optional driving circuitry 245 that generates, in use, driving signals 246, 247, 248, and three groups 297 . . . 299 of light sources. These elements of the luminaire are similar to the corresponding elements discussed in the context of FIG. 2*a*. The example of the luminaire comprises three reflectors 285 . . . 287 and in each one of the reflectors 285 . . . 287 is provided a single group of the groups 297 . . . 299 of light sources. One reflector with a single group of light sources is configured to emit a beam of light into a direction to where the one reflector is directed. The possible embodiments of luminaires are not limited to luminaires comprising reflectors. Other luminaires in which a plurality of groups of light sources is provided may also be equipped with embodiments of the earlier discussed lighting assembly.

Figure 3:
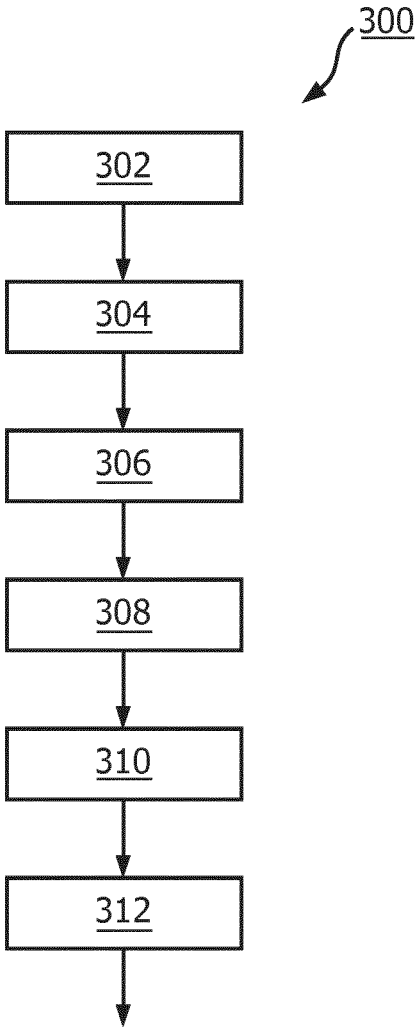

FIG. 3 schematically shows a method 300 of manufacturing a lighting assembly comprising a plurality of light source groups each comprising a first light source, a second light source and a third light source. The method 300 comprises i) receiving 302 a set of first light sources, the first light sources being configured to emit first light having a first color point and a first correlated color temperature, the first color point being within 7 SDCM from a black body line, the first correlated color temperature being higher than 5000 Kelvin; ii) receiving 304 a set of second light sources, the second light sources being configured to emit second light having a second color point and a second correlated color temperature, the second color point being within 7 SDCM from a black body line, the second correlated color temperature being lower than 2250 Kelvin; iii) receiving 306 a set of third light sources, the third light sources being configured to emit greenish light having a third color point in the CIE 1931 XYZ color space within an intersection of half spaces $y>=1.04\,x$ and $y>=-0.0694x+0.4525$, each third light source being capable of emitting a specific maximum flux of light under the predefined standard operation conditions, the specific maximum flux of each individual third light source maximally deviates 35% from an average maximum flux of all the third light sources of the set of third light sources; iv) forming 308 groups of light sources, the groups comprising a first light source of the set of first light source, a second light source of the set of second light sources and a third light source of the groups of light sources; v) assembling 310 the groups of light sources into the lighting assembly; vi) assembling 312 a controller into the lighting assembly and coupling it to the light sources of the groups of light sources, the controller being configured to generate a first control signal, a second control signal and a third control signal for said light sources, wherein the first control signal, the second control signal and the third control signal indicate an amount of light to be emitted by the first light sources, the second light sources and the third light sources, respectively, the controller being configured to generate said respective control signals to obtain, in use, a combined light emission comprising the first light, the second light and the third light, the combined light emission having a controllable color point close to the black body line and having a correlated color.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements. In the lighting assembly claim enumerating several means, several of these means may be embodied by one and the same item of hardware. The mere fact that certain measures are recited in mutually different dependent claims does not indicate that a combination of these measures cannot be used to advantage.

Examples of a lighting assembly, a LED strip, a luminaire and a method of manufacturing the lighting assembly are defined in the following numbered clauses:

1. A lighting assembly (100) for emitting substantially white light of a controllable correlated color temperature, the lighting assembly (100) comprising:

a first light source (110) for emitting first light (111) having a first color point (158) and a first correlated color temperature, the first color point (158) being within 7 SDCM from a black body line (156), the first correlated color temperature being larger than 5000 Kelvin, a second light source (120) for emitting second light (121) having a second color point (162) and a second correlated color temperature, the second color point (162) being within 7 SDCM from the black body line, the second correlated color temperature being smaller than 2250 Kelvin, a third light source (130) for emitting greenish light (131), the greenish light (131) having a third color point (170, 180, 190) in the CIE 1931 XYZ color space within an intersection (166) of half spaces $y>=1.04\ x$ and $y>=-0.0694x+0.4524$, a controller (140) for generating a first control signal (141), a second control signal (142) and a third control signal (143) for said light sources (110, 120, 130), wherein the first control signal (141), the second control signal (142) and the third control signal (143) indicate an amount of light to be emitted by the first light source (110), the second light source (120) and the third light source (130), respectively, the controller (140) being configured to generate said respective control signals (141 . . . 143) to obtain, in use, a combined light emission comprising the first light (111), the second light (121) and the greenish light (131), the combined light emission having a controllable color point close to the black body line (156).

2. A lighting assembly (100) according to clause 1, wherein the third light source (130) comprises one of i) a green emitting solid state light emitter die and ii) a solid state light emitter provided with luminescent material, wherein the luminescent is configured to convert a portion of the light emitted by the solid state light emitter towards light of another color and wherein the greenish light is a combination of another portion of the light emitted by the solid state light emitter and the light of the another color as emitted by the luminescent material.

3. A lighting assembly (100) according to any one of the preceding clauses, wherein the third color point (172, 182, 192), in the CIE 1931 XYZ color space, is within one of the following areas:

a first area (172) defined by a polygon of which the corners are the color points (x,y)=(0.129, 0.740), (x,y)=(0.238, 0.740), (x,y)=(0.243, 0.700) and (x,y)=(0.146, 0.696), a second area (190) defined by a polygon of which the corners are the color points (x,y)=(0.382, 0.506), (x,y)=(0.397, 0.499), (x,y)=(0.434, 0.567) and (x,y)=(0.421, 0.582), a third area (180) defined by a polygon of which the corners are the color points (x,y)=(0.388, 0.496), (x,y)=(0.401, 0.487), (x,y)=(0.365, 0.415) and (x,y)=(0.350, 0.420).

4. A lighting assembly (100) according to any one of the preceding clauses, wherein a maximum flux that can be emitted by the third light source (130) under predefined standard operation conditions is smaller than 50 percent of the sum of the maximum fluxes that can be emitted by the first light source and the second light source under the predefined standard operation conditions.

5. A lighting assembly (100) according to any one of the preceding clauses, wherein at least one of the first light source (110) and the second light source (120) comprises a solid state light emitter.

6. A lighting assembly (100) according to any one of the preceding clauses, wherein the first light source (110) comprises a first luminescent material and/or the second light source (120) comprises a second luminescent material, the first luminescent material being configured to convert a portion of the light emitted by a light emitter of the first light source towards light of a first other color and the first light being a combination of another portion of the light emitted by the light emitter of the first light source and the light of the first other color as emitted by the first luminescent material, the second luminescent material being configured to convert a portion of the light emitted by a light emitter of the second light source towards light of a second other color and the second light being a combination of another portion of the light emitted by the light emitter of the second light source and the light of the second other color as emitted by the second luminescent material.

7. A lighting assembly (100) according to any one of the clauses 4-6 comprising a plurality of groups (290 . . . 299) of light sources, each group (290 . . . 299) of light sources comprising the first light source (210), the second light source (22) and the third light source (230), the first light sources of the plurality of groups are controlled by the first control signal, the second light sources of the plurality of groups are controlled by the second control signal, the third light sources of the plurality of groups are controlled by the third control signal.

8. A lighting assembly (100) according to clause 7, wherein each third light source being capable of emitting a specific maximum flux of light under the predefined standard operation conditions, the specific maximum flux of each individual third light source maximally deviates 35% from an average maximum flux of all third light sources of the plurality of groups and the specific maximum flux of at least one of the third light sources deviates more than 10% from the average maximum flux.

9. A lighting assembly (100) according to clause 8, wherein each first light source being capable of emitting a further specific maximum flux of light under the predefined standard operation conditions, the further specific maximum flux of each individual first light source maximally deviates 20% from a further average flux of all first light sources of the plurality of groups and the further specific maximum flux of at least one of the first light sources deviates more than 7.5% from the further average maximum flux.

10. A lighting assembly (100) according to clause 8 or clause 9, wherein each second light source being capable of emitting another specific maximum flux of light under the predefined standard operation conditions, the another specific maximum flux of each individual second light source maximally deviates 20% from another average flux of all second light sources of the plurality of groups and the another specific maximum flux of at least one of the second light sources deviates more than 7.5% from the another average maximum flux.

11. A LED strip (200) comprising the lighting assembly according to any one of the clauses 7-10, wherein said light sources comprise a solid state light source.

12. A LED strip (200) according to clause 11, wherein said light sources are provided on a flexible strip-shaped support.

13. A luminaire (250) comprising the lighting assembly according to any one of the clauses 1-10 or the LED strip according to any one of the clauses 11-12.

14. A luminaire (250) according to clause 13, wherein the lighting assembly comprises the plurality of groups of light sources as described in clause 7, 8, 9 or 10, and the luminaire being arranged to emit light from a plurality of spatially separated locations, at the plurality of spatially separated locations one group of light sources is provided.

15. Method (300) of manufacturing a lighting assembly comprising a plurality of light source groups each comprising a first light source, a second light source and a third light source, the method comprising:

receiving (302) a set of first light sources, the first light sources being configured to emit first light having a first color point and a first correlated color temperature, the first color point being within 7 SDCM from a black body line, the first correlated color temperature being higher than 5000 Kelvin, receiving (304) a set of second light sources, the second light sources being configured to emit second light having a second color point and a second correlated color temperature, the second color point being within 7 SDCM from a black body line, the second correlated color temperature being lower than 2250 Kelvin, receiving (306) a set of third light sources, the third light sources being configured to emit greenish light having a third color point in the CIE 1931 XYZ color space within an intersection of half spaces $y>=1.04\ x$ and $y>=-0.0694x+0.4524$, each third light source being capable of emitting a specific maximum flux of light under the predefined standard operation conditions, the specific maximum flux of each individual third light source maximally deviates 35% from an average maximum flux of all the third light sources of the set of third light sources, forming (308) groups of light sources, the groups comprising a first light source of the set of first light source, a second light source of the set of second light sources and a third light source of the groups of light sources, assembling (310) the groups of light sources into the lighting assembly, assembling (312) a controller into the lighting assembly and coupling it to the light sources of the groups of light sources, the controller being configured to generate a first control signal, a second control signal and a third control signal for said light sources, wherein the first control signal, the second control signal and the third control signal indicate an amount of light to be emitted by the first light sources, the second light sources and the third light sources, respectively, the controller being configured to generate said respective control signals to obtain, in use, a combined light emission comprising the first light, the second light and the third light, the combined light emission having a controllable color point close to the black body line and having a correlated color.

The invention claimed is:

1. A lighting assembly for emitting substantially white light of a controllable correlated color temperature, the lighting assembly comprising:

a plurality of groups of light sources, wherein, each group comprises a first light source, a second light source and a third light source, said first light sources are for emitting a first light having a first color point and a first correlated color temperature, the first color point being within 7 SDCM from a black body line, the first correlated color temperature being larger than 5000 Kelvin, said second light sources are for emitting a second light having a second color point and a second correlated color temperature, the second color point being within 7 SDCM from the black body line, the second correlated color temperature being smaller than 2250 Kelvin, and said third light sources are for emitting a greenish light, the greenish light having a third color point in the CIE 1931 XYZ color space within an intersection of half spaces $y>=1.04\ x$ and $y>=-0.0694x+0.4525$, each third light source being capable of emitting a specific maximum flux of light under predefined standard operation conditions, the specific maximum flux of each individual third light source maximally deviates 35% from an average maximum flux under the predefined standard operation conditions of all third light sources of the plurality of groups and the specific maximum flux of at least one of the third light sources deviates more than 10% from the average maximum flux under the predefined standard operation conditions of all third light sources of the plurality of groups; and a controller configured to generate a first control signal for controlling the first light sources, a second control signal for controlling the second light sources and a third control signal for controlling the third light sources, the first control signal, the second control signal and the third control signal control an amount of light to be emitted by said first light sources, said second light sources and said third light sources, respectively, the controller further configured to generate said respective control signals to obtain, in use, a combined light emission comprising the first light, the second light and the greenish light, the combined light emission having a controllable color point close to the black body line.

2. The lighting assembly according to claim 1, wherein each one of said third light sources comprises one of i) a green emitting solid state light emitter die or ii) a solid state light emitter provided with a luminescent material, wherein the luminescent material is configured to convert a portion of the light emitted by the solid state light emitter towards light of another color and wherein the greenish light emitted by each one of said third light sources is a combination of another portion of the light emitted by the solid state light emitter and the light of the another color as emitted by the luminescent material.

3. The lighting assembly according to claim 1, wherein the third color points of the third light sources, in the CIE 1931 XYZ color space, are within one of the following areas:

a first area defined by a polygon of which the corners are the color points (x,y)=(0.129, 0.740), (x,y)=(0.238, 0.740), (x,y)=(0.243, 0.700) and (x,y)=(0.146, 0.696);

a second area defined by a polygon of which the corners are the color points (x,y)=(0.382, 0.506), (x,y)=(0.397, 0.499), (x,y)=(0.434, 0.567) and (x,y)=(0.421, 0.582); or a third area defined by a polygon of which the corners are the color points (x,y)=(0.388, 0.496), (x,y)=(0.401, 0.487), (x,y)=(0.365, 0.415) and (x,y)=(0.350, 0.420).

4. The lighting assembly according to claim 1 wherein, for individual groups of the plurality of groups, a maximum flux that is emitted by the third light source of a specific group among the plurality of groups of light sources, under the predefined standard operation conditions, is limited to be smaller than 50 percent of the sum of the maximum fluxes that are emitted by the first light source of the specific group and the second light source of the specific group under the predefined standard operation conditions.

5. The lighting assembly according to claim 1, wherein at least one of the first light sources and the second light sources comprise solid state light emitters.

6. The lighting assembly according to claim 1, wherein the first light sources comprise a first luminescent material and/or the second light sources comprise a second luminescent material, the first luminescent material being configured to convert a portion of the light emitted by a light emitter of the first light sources towards light of a first other color and the first light being a combination of another portion of the light emitted by the light emitter of the first light source and the light of the first other color as emitted by the first luminescent material, the second luminescent material being configured to convert a portion of the light emitted by a light emitter of the second light sources towards light of a second other color and the second light being a combination of another portion of the light emitted by the light emitter of the second light source and the light of the second other color as emitted by the second luminescent material.

7. The lighting assembly according to claim 1, wherein each first light source is capable of emitting a further specific maximum flux of light under the predefined standard operation conditions, the further specific maximum flux of each individual first light source maximally deviates 20% from a further average flux of all first light sources of the plurality of groups and the further specific maximum flux of at least one of the first light sources deviates more than 7.5% from the further average maximum flux.

8. The lighting assembly according to claim 1, wherein each second light source is capable of emitting another specific maximum flux of light under the predefined standard operation conditions, the another specific maximum flux of each individual second light source maximally deviates 20% from another average flux of all second light sources of the plurality of groups and the another specific maximum flux of at least one of the second light sources deviates more than 7.5% from the another average maximum flux.

9. An LED strip comprising the lighting assembly according to claim 1, wherein each of said groups of light sources comprises a solid state light source.

10. An LED strip according to claim 9, wherein said light sources are provided on a flexible strip-shaped support.

11. The lighting assembly according to claim 1, wherein the lighting assembly is formed within a luminaire.

12. A luminaire according to claim 11, wherein the luminaire is arranged to emit light from a plurality of spatially separated locations, at the plurality of spatially separated locations one group of light sources is provided.

13. A method of manufacturing a lighting assembly, the method comprising:

receiving a set of first light sources, the first light sources being configured to emit first light having a first color point and a first correlated color temperature, the first color point being within 7 SDCM from a black body line, the first correlated color temperature being higher than 5000 Kelvin;

receiving a set of second light sources, the second light sources being configured to emit second light having a second color point and a second correlated color temperature, the second color point being within 7 SDCM from a black body line, the second correlated color temperature being lower than 2250 Kelvin;

receiving a set of third light sources, the third light sources being configured to emit greenish light having a third color point in the CIE 1931 XYZ color space within an intersection of half spaces $y>=1.04\ x$ and $y>=-0.0694x+0.4525$, each third light source being capable of emitting a specific maximum flux of light under the predefined standard operation conditions, the specific maximum flux of each individual third light source maximally deviates 35% from an average maximum flux under the predefined standard operation conditions of all the third light sources of the set of third light sources, and the specific maximum flux of at least one of the third light sources deviates more than 10% from the average maximum flux under the predefined standard operation conditions of all third light sources of the plurality of groups;

forming groups of light sources, each group comprising a first light source of the set of first light source, a second light source of the set of second light sources and a third light source of the set of third light sources; and coupling a controller to the light sources of the groups of light sources, the controller being configured to generate a first control signal for controlling the first light sources, a second control signal for controlling the second light sources and a third control signal for controlling the third light sources, wherein the first control signal, the second control signal and the third control signal control an amount of light to be emitted by the first light sources, the second light sources and the third light sources, respectively, the controller being configured to generate said respective control signals to obtain, in use, a combined light emission comprising the first light, the second light and the third light, the combined light emission having a controllable color point close to the black body line and having a correlated color.

* * * * *